US008160483B2

(12) United States Patent
Lee et al.

(10) Patent No.: US 8,160,483 B2
(45) Date of Patent: Apr. 17, 2012

(54) IMAGE FORMING APPARATUS WHICH CAN PREVENT INFERIOR IMAGE QUALITY DUE TO CURRENT LEAKAGE

(75) Inventors: Sun-woo Lee, Hwaseong-si (KR); Won-chul Jung, Suwon-si (KR); Myung-ho Kyung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 398 days.

(21) Appl. No.: 12/507,957

(22) Filed: Jul. 23, 2009

(65) Prior Publication Data

US 2010/0040396 A1 Feb. 18, 2010

(30) Foreign Application Priority Data

Aug. 18, 2008 (KR) ..... 10-2008-0080495

(51) Int. Cl.
*G03G 15/14* (2006.01)

(52) U.S. Cl. ..... 399/315
(58) Field of Classification Search ..... 399/298, 399/299, 315
See application file for complete search history.

(56) References Cited

U.S. PATENT DOCUMENTS

| | | | | |
|---|---|---|---|---|
| 6,571,079 | B2 | 5/2003 | Nagaoka et al. | |
| 7,130,568 | B2 | 10/2006 | Mochizuki | |
| 7,620,354 | B2 * | 11/2009 | Shimura et al. | 399/315 |

FOREIGN PATENT DOCUMENTS

| | | |
|---|---|---|
| JP | 10-282798 | 10/1998 |
| JP | 2005-338627 | 12/2005 |
| JP | 2006-243086 | 9/2006 |

* cited by examiner

*Primary Examiner* — William J Royer
(74) *Attorney, Agent, or Firm* — Stanzione & Kim, LLP

(57) ABSTRACT

An image forming apparatus may include: a plurality of image bearing members; an exposure unit; a developing unit; a transfer unit including a plurality of transfer rollers and a plurality of erasers each disposed between the transfer rollers; and a fixing unit. The eraser may be disposed in a zone Z1 satisfying the following formula:

$D1 \leq Z1 \leq D-D3$; $D1=4.5$ mm; $D3=4.5$ mm; and $9.0$ mm$<D$

Here, D1 may be an allowable minimum distance between an end part of the eraser and a center of a first transfer nip between a first image bearing member and a first transfer roller; D3 may be an allowable minimum distance between the end part of the eraser and a center of a second transfer nip between a second image bearing member and a second transfer roller; and D may be a distance between the centers of the transfer nips.

9 Claims, 7 Drawing Sheets

IMAGE FORMING APPARATUS WHICH CAN PREVENT INFERIOR IMAGE QUALITY DUE TO CURRENT LEAKAGE

CROSS-REFERENCE TO RELATED APPLICATIONS

This application claims priority under 35 U.S.C. §119(a) of Korean Patent Application No. 2008-0080495, filed on Aug. 18, 2008 in the Korean Intellectual Property Office, the disclosure of which is incorporated herein by reference.

BACKGROUND

1. Field of the Invention

The present general inventive concept relates to an image forming apparatus, and more particularly, to an image forming apparatus, which can prevent inferior image quality due to current leakage by an optimized installation of an eraser.

2. Description of the Related Art

FIG. 1 schematically illustrates a conventional tandem-type electro-photographic image forming apparatus.

Referring to FIG. 1, a conventional image forming apparatus includes a plurality of image bearing members 10, on which an image is formed by a developing unit (not illustrated); a transfer unit 20 which transfers a visible image formed on each image bearing member 10 onto a printing medium M; and a fixing unit 30 which fixes an image on the printing medium M by heat and pressure.

The transfer unit 20 includes a plurality of transfer rollers 21 disposed opposite to their respective image bearing member 10, and a transfer belt 25 feeding the printing medium M while passing between the image bearing member 10 and the transfer rollers 21. The transfer unit 20 directly transfers a toner on each image bearing member 10 to the printing medium M by a transfer voltage applied to the transfer roller 21 and having a polarity opposite to that of a voltage applied to the image bearing members 10. When the transfer voltage is applied to the transfer roller 21, the transfer voltage is also applied to the printing medium M.

When the printing medium M passes through a transfer nip formed between each image bearing member 10 and each transfer roller 21, gap discharge (that is, printing medium detachment discharge) is generated in the front or the rear of the transfer nip, particularly, in an area A in front of the transfer nip as illustrated in FIG. 1, due to electric potential difference between the image bearing member 10 and the printing medium M, thereby causing scattering in an image formed by a toner.

In order to prevent the image scattering due to the gap discharge in the area A, a conventional image forming apparatus includes an eraser 40, as illustrated in FIG. 2. The eraser 40 erases a voltage applied to the printing medium M to reduce electric potential difference between the image bearing member 10 and the printing medium M, thereby restraining the gap discharge.

Generally, current flowing between an eraser and the ground is less than 0.1-1.0 μA. Thus, when the eraser 40 is disposed near the transfer roller 21, a transfer current may not flow from the transfer roller 21 toward the printing medium M due to high resistance of the printing medium M under a certain condition, and thus, current leakage may occur toward the eraser 40 via the transfer belt 25, thereby causing inferior image quality.

Hence, an eraser should be installed in such a position as to prevent current leakage toward the eraser.

Further, in a conventional electro-photographic image forming apparatus, when a printing medium of high resistance is used under a low-humidity environment or during duplex printing, resistance of a transfer belt increases. Thus, the amount of electric charges accumulated in the transfer belt is rapidly increased. As a result, it is difficult to form an electric field only by applying a voltage to a pressing roller (35 in FIG. 1) of the fixing unit 30, thereby causing an electrostatic offset. Thus, when a printing medium with toner being transferred is fixed in the electrified state, inferior image quality is likely to occur due to the electrostatic offset.

SUMMARY

The present general inventive concept provides an image forming apparatus which can prevent inferior image quality due to current leakage toward an eraser and due to an electrostatic offset.

Additional features and utilities of the present general inventive concept will be set forth in part in the description which follows and, in part, will be obvious from the description, or may be learned by practice of the present general inventive concept.

Embodiments of the present general inventive concept can be achieved by providing an image forming apparatus including a plurality of image bearing members spaced apart from each other and including a first image bearing member and a second image bearing member to be disposed adjacent to the first image bearing member, an exposure unit to form a latent image on each of the image bearing members, a developing unit to form a visible image on each of the image bearing members, a transfer unit transferring the visible image onto a printing medium including a plurality of transfer rollers which may be respectively disposed opposite to the plurality of image bearing members and form a transfer nip between each transfer roller and each image bearing member and a plurality of erasers which may be respectively disposed between the plurality of transfer rollers and erase a transfer voltage in the printing medium, and a fixing unit to fix the visible image on the printing medium. The plurality of transfer rollers may include a first transfer roller and a second transfer roller which may be disposed opposite to the first image bearing member and the second image bearing member, respectively. At least one of the plurality of erasers may be disposed between the first transfer roller and the second transfer roller in a zone Z1 satisfying the following formula:

$$D1 \leqq Z1 \leqq D\text{-}D3$$

D1=4.5 mm

D3=4.5 mm 9.0 mm<D

Here, D1 may be an allowable minimum distance between an end part of the eraser and a center of a first transfer nip formed between the first image bearing member and the first transfer roller, D3 may be an allowable minimum distance between the end part of the eraser and a center of a second transfer nip formed between the second image bearing member and the second transfer roller, and D may be a distance between the center of the first transfer nip and the center of the second transfer nip.

Each of the plurality of erasers may include a first erasing plate disposed substantially perpendicular to a traveling path of the printing medium.

At least one of the first erasing plates may be disposed in a zone Z2 satisfying the following formula:

$$R1+D2 \leqq Z2 \leqq D-(R2+D4)$$

D2=1.7 mm

D4=1.7 mm

Here, R1 may be a radius of the first transfer roller, R2 may be a radius of the second transfer roller, D2 may be an allowable minimum distance between the first erasing plate of the eraser and the nearest periphery of the first transfer roller, and D4 may be an allowable minimum distance between the first erasing plate of the eraser and the nearest periphery of the second transfer roller.

Each of the plurality of erasers may include a second erasing plate disposed in parallel with a traveling path of the printing medium.

The transfer unit may further include a transfer belt passing between the plurality of image bearing members and the plurality of transfer rollers and feeding the printing medium.

The transfer unit may further include an auxiliary eraser disposed between the transfer roller in the most downstream position along the printing medium traveling path and the fixing unit and may erase a transfer voltage in the printing medium.

An end part of the auxiliary eraser may be disposed in a zone Z3 satisfying the following formula:

$$D5 \leqq Z3 < DF$$

D5=4.5 mm

Here, D5 may be an allowable minimum distance along the printing medium traveling path between a center of a last transfer nip formed between the image bearing member adjacent to the fixing unit and the corresponding transfer roller and the end part of the auxiliary eraser, and DF may be a distance along the printing medium traveling path between the center of the last transfer nip and a center of a fixing nip of the fixing unit.

The auxiliary eraser may include an auxiliary erasing plate disposed substantially perpendicular to the printing medium traveling path, the auxiliary erasing plate being disposed in a zone Z4 satisfying the following formula:

$$R3+D6 \leqq Z4 \leqq DF-R4$$

D6=1.7 mm≦D6<DF

Here, R3 may be a radius of the transfer roller adjacent to the fixing unit, R4 may be a radius of a pressing roller of the fixing unit, and D6 may be an allowable minimum distance between the auxiliary erasing plate of the auxiliary eraser and the nearest periphery of the transfer roller adjacent to the fixing unit.

The auxiliary erasing plate of the auxiliary eraser may be disposed in parallel with the printing medium traveling path.

BRIEF DESCRIPTION OF THE DRAWINGS

These and/or other features and utilities of the present general inventive concept will become apparent and more readily appreciated from the following description of the embodiments, taken in conjunction with the accompanying drawings, in which.

DETAILED DESCRIPTION OF THE EMBODIMENTS

Figure 1:
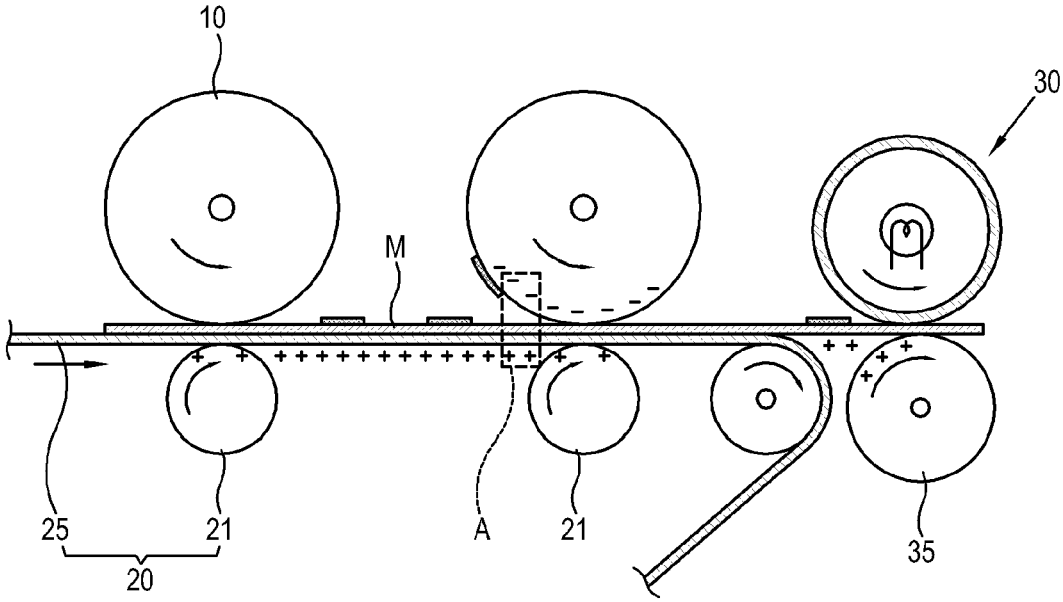
FIG. 1 (PRIOR ART)
FIG. 1 schematically illustrates a conventional tandem-type electro-photographic image forming apparatus.
Figure 2:
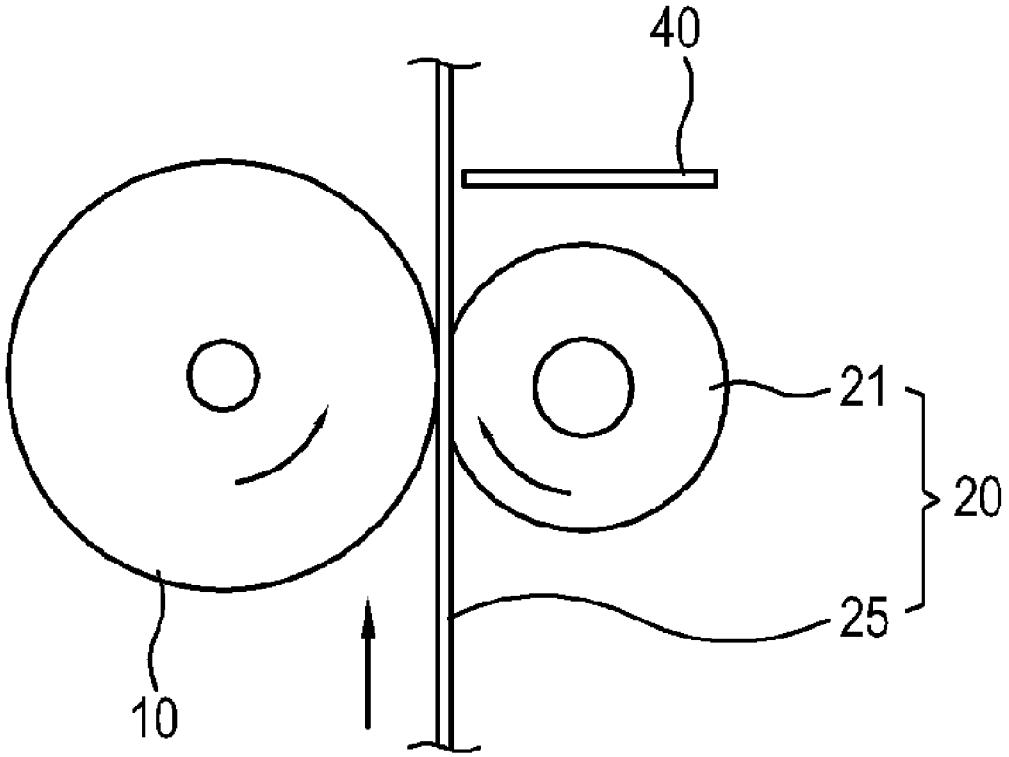
FIG. 2 (PRIOR ART)
FIG. 2 partially illustrates a conventional image forming apparatus having an eraser.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures. Repetitive description to like elements of different embodiments may be omitted as necessary.

Figure 3:
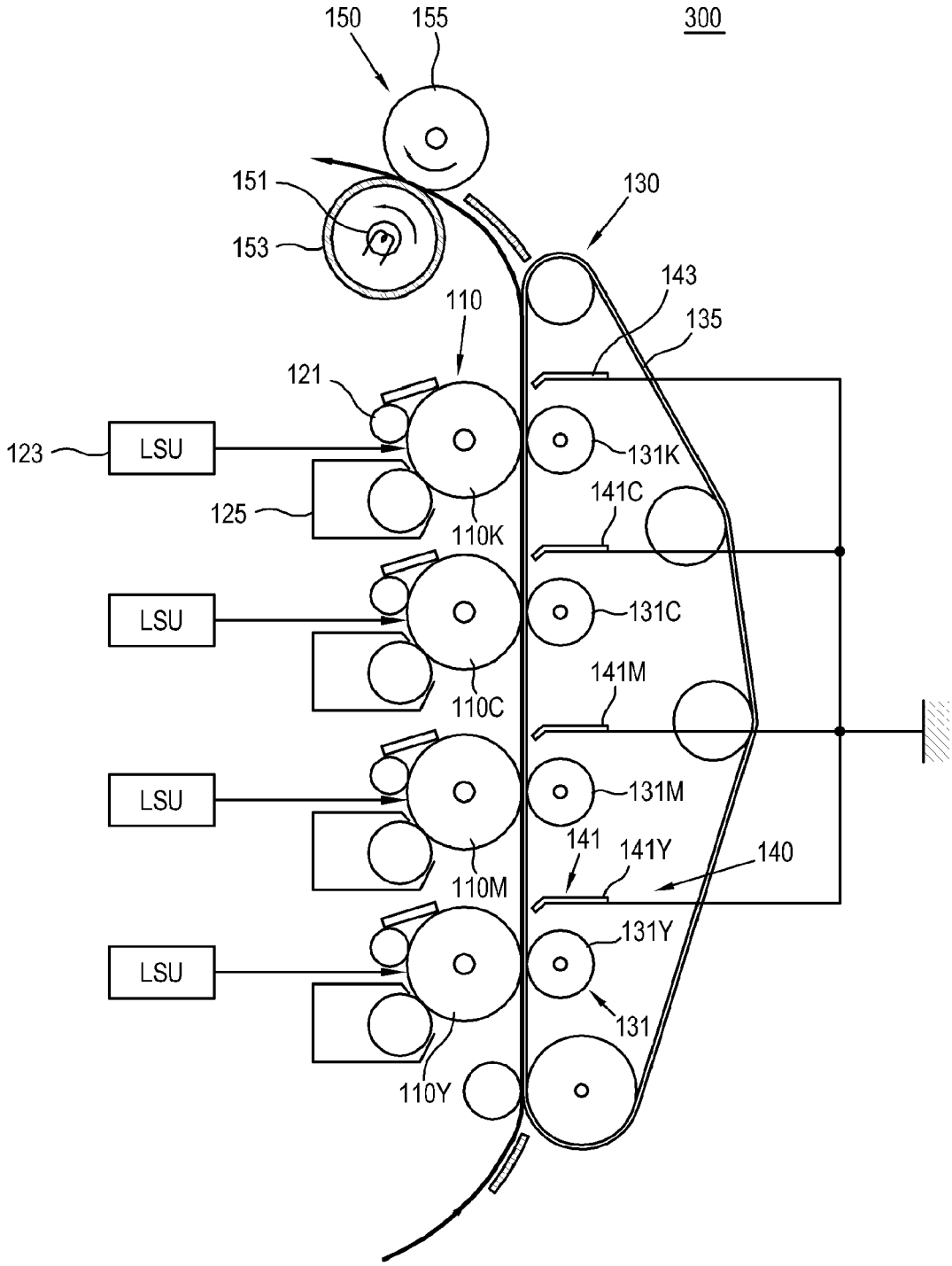
FIG. 3 schematically illustrates an image forming apparatus according to an exemplary embodiment of the present general inventive concept.

FIG. 3 schematically illustrates an image forming apparatus 300 according to an exemplary embodiment of the present general inventive concept.

Referring to FIG. 3, the image forming apparatus 300 according to an exemplary embodiment of the present general inventive concept is illustrated in FIG. 3 as a tandem-type electro-photographic image forming apparatus in which images of a plurality of colors may be transferred onto a printing medium in a single path. This image forming apparatus 300 may include a plurality of color image bearing members 110 disposed spacedly apart from each other in a printing path, a plurality of exposure units 123 to form a latent image on the respective image bearing members 110, a plurality of developing units 125 to form a visible image on the respective image bearing members 110, a transfer unit 130; and a fixing unit 150. The image forming apparatus 300 may further include an electrifier 121 to electrify each image bearing member 110 at a predetermined electric potential.

The exposure unit 123 may expose the image bearing member 110 electrified by the electrifier 121 to light to form a latent image thereon, and may include a light scan unit (LSU) to scan light corresponding to an image to be printed on a printing medium.

The developing units 125 may be provided with a plurality of colors, and may provide toner to the image bearing members 110 on which latent images may be formed to form visible images.

The transfer unit 130 may transfer the visible image onto a printing medium supplied along a printing medium traveling path, and may include a plurality of transfer rollers 131 and a plurality of erasers 140 respectively disposed between the adjacent transfer rollers 131 to erase a transfer voltage useable with the printing medium. Each transfer roller 131 may be disposed opposite to each image bearing member 110 and may form a transfer nip between the transfer roller 131 and the image bearing member 110. As illustrated in FIG. 3, the plurality of image bearing members 110 may include first to fourth image bearing members 110Y, 110M, 110C, and 110K. The plurality of transfer rollers 131 may include first to fourth transfer rollers 131Y, 131M, 131C, and 131K corresponding to the first to fourth image bearing members 110Y, 110M, 110C, and 110K, respectively. Further, the transfer unit 130 may include a transfer belt 135 which may pass between the plurality of image bearing members 110 and the plurality of transfer rollers 131 and may feed the printing medium.

The plurality of erasers 140 may prevent image scattering due to gap discharge generated in a front area of the transfer nip due to electric potential difference between the image bearing member 110 and the printing medium when the printing medium passes through the transfer nip formed between the image bearing member 110 and the transfer roller 131. To this end, the plurality of erasers 140 may include a first eraser 141Y disposed between the first transfer roller 131Y and the second transfer roller 131M; a second eraser 141M disposed between the second transfer roller 131M and the third transfer roller 131C; and a third eraser 141C disposed between the third transfer roller 131C and the fourth transfer roller 131K.

Each image bearing member 110 contains a rotating axis. For example in FIG. 4, the rotating axis of the first image bearing member 110Y is illustrated and labeled as 111Y. Also, each transfer roller 131 contains a rotating axis. For example in FIG. 4, the rotating axis of the first transfer roller 131Y is illustrated and labeled as 132Y.

Each of the first to third erasers 141Y, 141M, and 141C may include an erasing plate 141 disposed substantially perpendicular to the printing medium traveling path.

The erasers 140 may be divided into two sections. For example in FIG. 4, a section 141B of first eraser 141Y is parallel to a line connecting the rotating axis of the first transfer roller 131Y with the rotating axis of the first image bearing member 110Y. Also, a section 141C of the first eraser 141Y is bent from 141B toward the rotating axis of the first image bearing member 110Y. In other words, the section 141C of the first eraser 141Y is bent to minimize the distance between the first eraser 141Y and the first transfer roller 131Y.

Further, an end part 141*a* of the eraser 141Y may be disposed between perimeters of the image bearing member 110Y and the transfer roller 131Y. Also, the end part 141*a* of the eraser 141Y may be disposed between a line passing the rotation axes of the image bearing member 110Y and transfer roller 131Y and a line connecting circumference surfaces of the image bearing member 110Y and the transfer roller 131Y.

Figure 4:
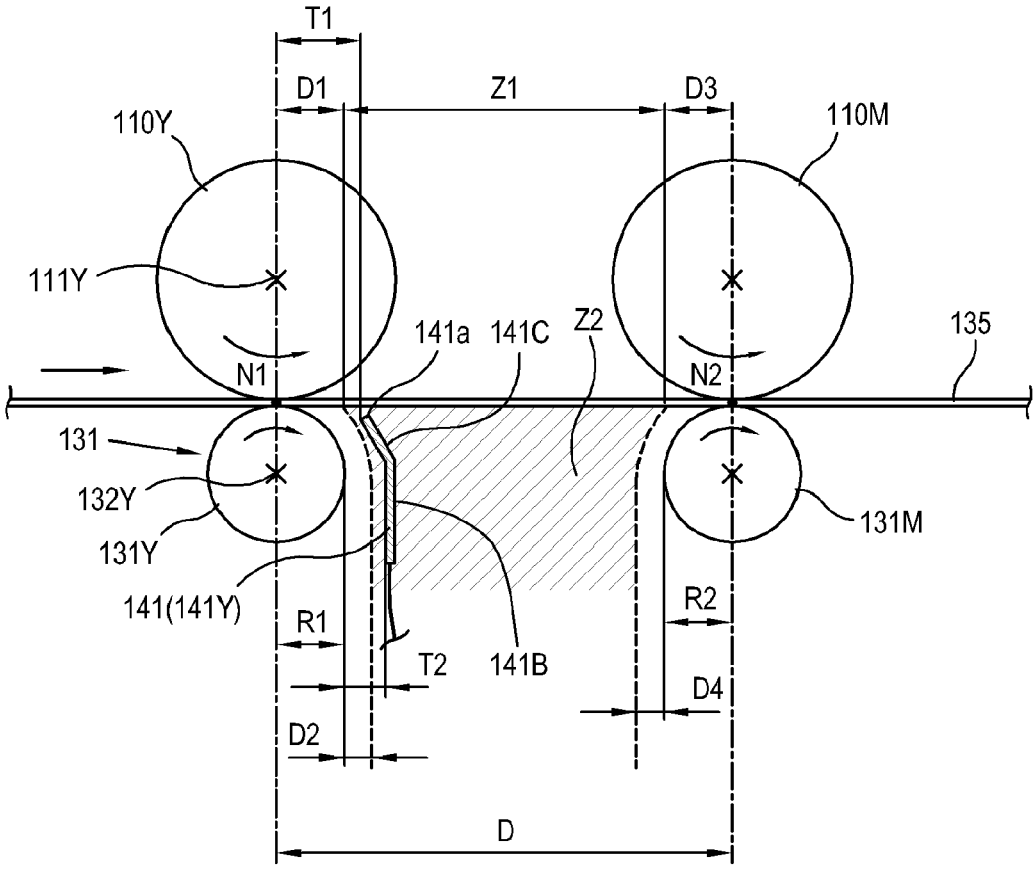
FIG. 4 schematically illustrates a main part of the image forming apparatus in FIG. 3.

Also, the end part 141*a* of the eraser 141Y, as illustrated in FIG. 4, may be disposed adjacent to a corresponding transfer roller 131Y and between a first line connecting rotation axes of the image bearing member 110Y and transfer roller 131Y and a second line parallel to the first line and tangent to a circumference surface of the image bearing member 110Y.

The fixing unit 150 may fix a visible image which may be transferred onto the printing medium M by the transfer unit 130 on the printing medium, and may include a heat source 151, a fixing roller 153, and a pressing roller 155 to press the printing medium against the fixing roller 153.

According to the present embodiment, the erasers 140 may be arranged such that gap discharge with respect to the adjacent transfer rollers 131 can be effectively prevented and at the same time current leakage toward the erasers 140 can be effectively prevented.

Referring to FIG. 4, which schematically illustrates a main part of the image forming apparatus 300 according to the present embodiment, the first eraser 141Y disposed between the first transfer roller 131Y and the second transfer roller 131M may be disposed in a zone Z1 satisfying the following formula 1:

$$D1 \leqq Z1 \leqq D - D3$$

D1=4.5 mm

D3=4.5 mm 9.0 mm<D

Here, D1 may be an allowable minimum distance between the end part 141*a* of the eraser 141Y and a center N1 of a first transfer nip, D3 may be an allowable minimum distance between the end part 141*a* of the eraser 141Y and a center N2 of a second transfer nip, and D may be a distance between the center N1 and the center N2. In this respect, the first transfer nip may be formed between the first image bearing member 110Y and the first transfer roller 131Y, and the second transfer nip may be formed between the second image bearing member 110M and the second transfer roller 131M. In the formula 1, the center N1 of the first transfer nip may be considered as an origin.

The distance T1 between the center N1 of the first transfer nip and the end part 141*a* of the eraser 141Y may be greater than or equal to the allowable minimum distance D1 between the end part 141*a* of the eraser 141Y and the center N1 of the first transfer nip.

The conditions of formula 1 may be set in consideration of an erasing current depending on the distance between the center N1 of the transfer nip and the end part 141*a* of the eraser 141Y and a transfer state.

Table 1 represents erasing currents depending on change in the distance T1 between the center N1 of the first transfer nip to the end part 141*a* of the eraser 141Y when a transfer current of 10 μA is used under a low-temperature and low-humidity environment

TABLE 1

| T1 (mm) | 3.0 | 3.5 | 4.0 | 4.5 | 5.0 |
|---|---|---|---|---|---|
| Erasing current (μA) | 3.8 | 2.2 | 1.2 | 0.8 | 0.8 |
| Transfer grade | 4 | 3 | 2 | 1 | 1 |

In Table 1, decreasing erasing currents means that current leakage becomes smaller, that is, the transfer grade or an erasing characteristic becomes better. Further, it is illustrated that if the distance T1 between the center N1 of the first transfer nip and the end part 141*a* of the eraser 141Y is smaller than 4.5 mm, the transfer grade is 2, 3, and 4, which means that current leakage toward the eraser 141Y may be relatively high. Thus, it may be preferable that the distance T1 is 4.5 mm or above.

The erasing characteristic in Table 1 may be applicable to the relationship between the eraser 141Y and the second transfer roller 131M, and thus, a distance between the end part 141*a* of the eraser 141Y and the center N2 of the second transfer nip may be preferably 4.5 mm or above.

Further, the erasing plate 141 of the first eraser 141Y may be disposed in a zone Z2 satisfying the following formula 2:

$$R1 + D2 \leqq Z2 \leqq D - (R2 + D4)$$

D2=1.7 mm

D4=1.7 mm

Here, R1 may be a radius of the first transfer roller 131Y, R2 may be a radius of the second transfer roller 131M, D2 may be an allowable minimum distance between the erasing plate 141 of the eraser 141Y and the nearest periphery of the first transfer roller 131Y, and D4 may be an allowable minimum distance between the erasing plate 141 of the eraser 141Y and the nearest periphery of the second transfer roller 131M.

The conditions of formula 2 may be set in consideration of an erasing current depending on the distance between the transfer roller 131Y and the erasing plate 141 of the eraser 141Y and a transfer state.

Table 2 represents erasing currents according to change in the distance T2 between the erasing plate 141 and the nearest periphery of the first transfer roller 131Y when a transfer current of 10 μA is applied under a low-temperature and low-humidity environment

TABLE 2

| T2 (mm) | 0.5 | 0.9 | 1.3 | 1.7 | 2.1 |
|---|---|---|---|---|---|
| Erasing current (μA) | 0.8 | 0.6 | 0.2 | 0.0 | 0.0 |
| Transfer grade | 2 | 2 | 2 | 1 | 1 |

As illustrated in Table 2, if the distance T2 between the erasing plate 141 and the nearest periphery of the first transfer roller 131Y is less than 1.7 mm, the transfer grades may be 2, which means that current leakage toward the eraser 141Y may be relatively high. Thus, it may be preferable that T2 is 1.7 mm or above.

The erasing characteristic of Table 2 may be applicable to the relationship between the eraser 141Y and the second transfer roller 131M, and thus, it may be preferable that the distance between the erasing plate 141 of the eraser 141Y and the nearest periphery of the second transfer roller 131M is 1.7 mm or above.

Formulas 1 and 2 useable with the first eraser 141Y may be also applicable to the second and third erasers 141M and 141C.

The transfer unit 130 may be disposed between the last fourth transfer roller 131K and the fixing unit 150, and may further include an auxiliary eraser 143 to erase a transfer voltage in the printing medium after toner transferring is completed to the printing medium, so as to prevent an electrostatic offset, and thus inferior image quality.

Figure 5:
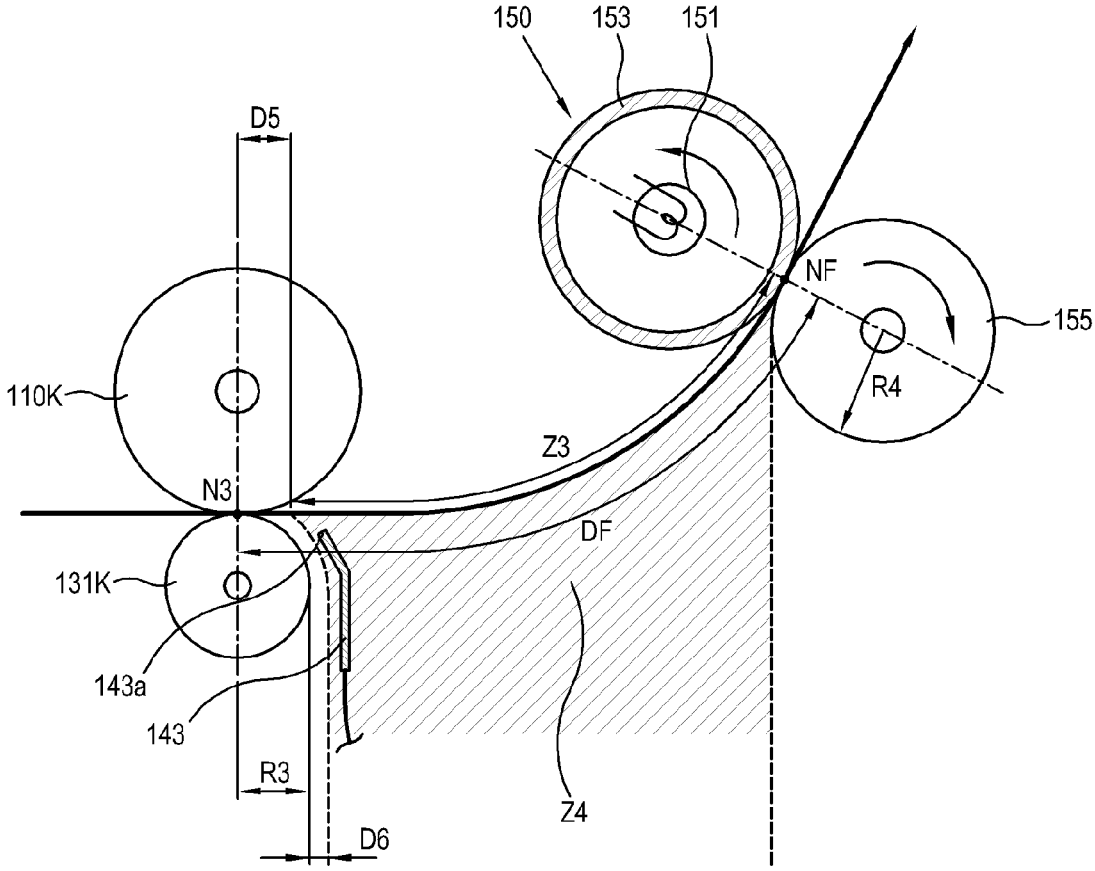
FIG. 5 schematically illustrates another main part of the image forming apparatus in FIG. 3.

FIG. 5 schematically illustrates a main part of the image forming apparatus 300 in FIG. 3. Referring to FIG. 5, the auxiliary eraser 143 may be disposed between the fourth transfer roller 131K and the pressing roller 155, and may be arranged in a zone Z3 satisfying the following formula 3:

$$D5 \leqq Z3 < DF$$

D5=4.5 mm

Here, D5 may be an allowable minimum distance along the printing medium traveling path between a center N3 of a transfer nip formed between the fourth image bearing member 110K and the fourth transfer roller 131K and an end part 143*a* of the auxiliary eraser 143; and DF may be a distance along the printing medium traveling path between the center N3 and a center NF of a fixing nip of the fixing unit 150.

By arranging the auxiliary eraser 143 in this manner, the first transfer grade can be maintained, as represented in Table 1. Thus, current leakage, which may be generated due to a close distance between the center N3 of the transfer nip and the end part 143*a* of the auxiliary eraser 143, can be prevented.

Figure 6:
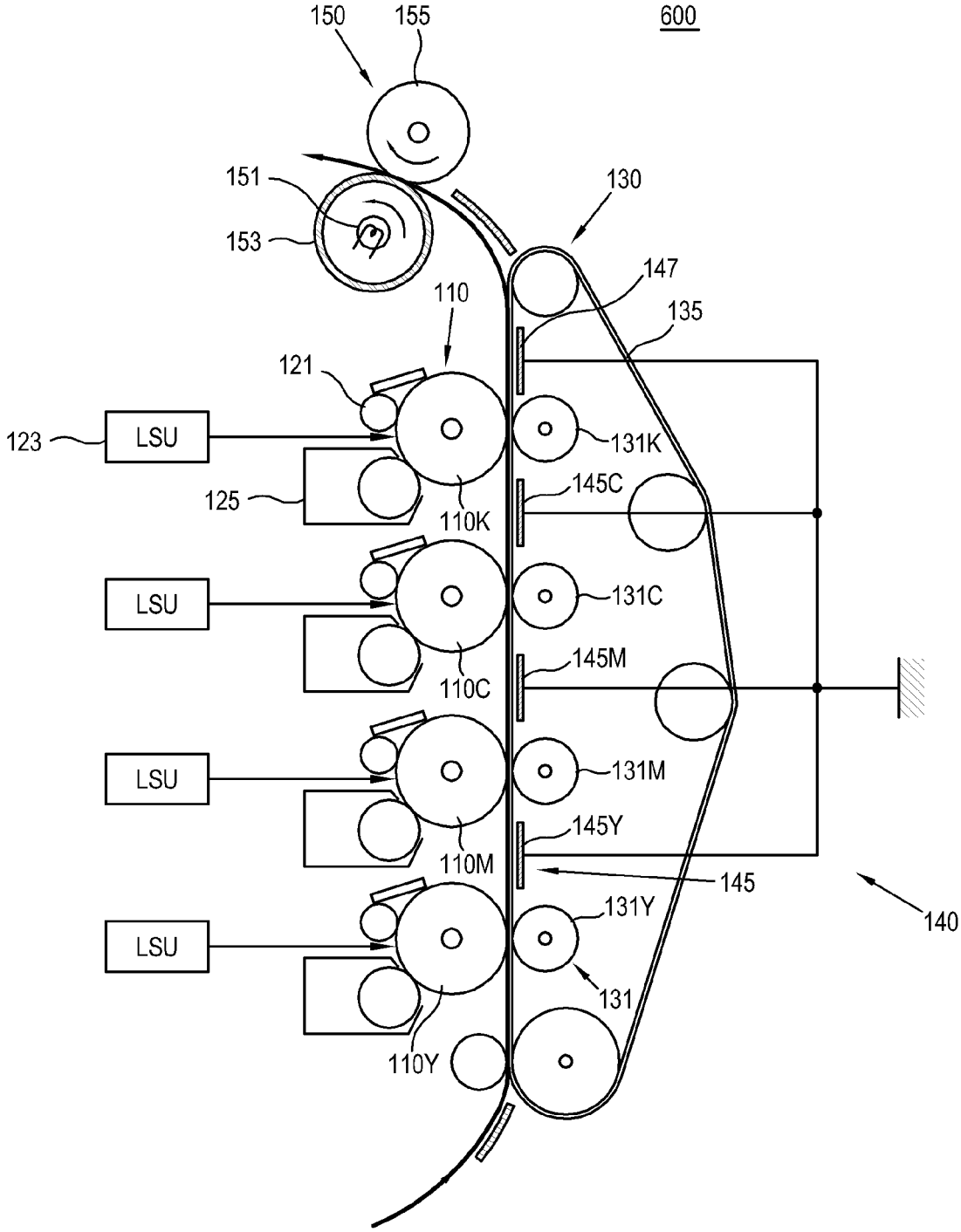
FIG. 6 schematically illustrates an image forming apparatus according to another exemplary embodiment of the present general inventive concept.

Further, the auxiliary eraser 143 may include an erasing plate disposed substantially perpendicular to the printing medium traveling path, as illustrated in FIGS. 3 and 6. Preferably, the erasing plate of the auxiliary eraser 143 may be arranged in a zone Z4 satisfying the following formula 4:

$$R3 + D6 \leqq Z4 \leqq DF - R4$$

D6=1.7 mm

Here, R3 may be a radius of the fourth transfer roller 131K adjacent to the fixing unit 150; R4 may be a radius of the pressing roller 155; and D6 may be an allowable minimum distance between the erasing plate of the auxiliary eraser 143 and the nearest periphery of the fourth transfer roller 131K.

By arranging the auxiliary eraser 143 in this way, the first transfer grade can be maintained as illustrated in Table 2. Thus, current leakage, which may be generated due to a close distance between the fourth transfer roller 131K and the end part 143*a* of the auxiliary eraser 143, can be prevented.

FIG. 6 schematically illustrates an image forming apparatus 600 according to another exemplary embodiment of the present general inventive concept.

The image forming apparatus 600, according to another exemplary embodiment of the present general inventive concept, may also be a tandem-type electro-photographic image forming apparatus 300, and is different from the image forming apparatus according to an exemplary embodiment of the present general inventive concept in that a configuration of a plurality of erasers 140 may be modified.

Referring to FIG. 6, the plurality of erasers 140 may include first to third erasers 145Y, 145M, and 145C, respectively disposed between first to fourth transfer rollers 131Y, 131M, 131C, and 131K. Each of the first to third erasers 145Y, 145M, and 145C may have an erasing plate 145 disposed in parallel with a printing medium traveling path.

Figure 7:
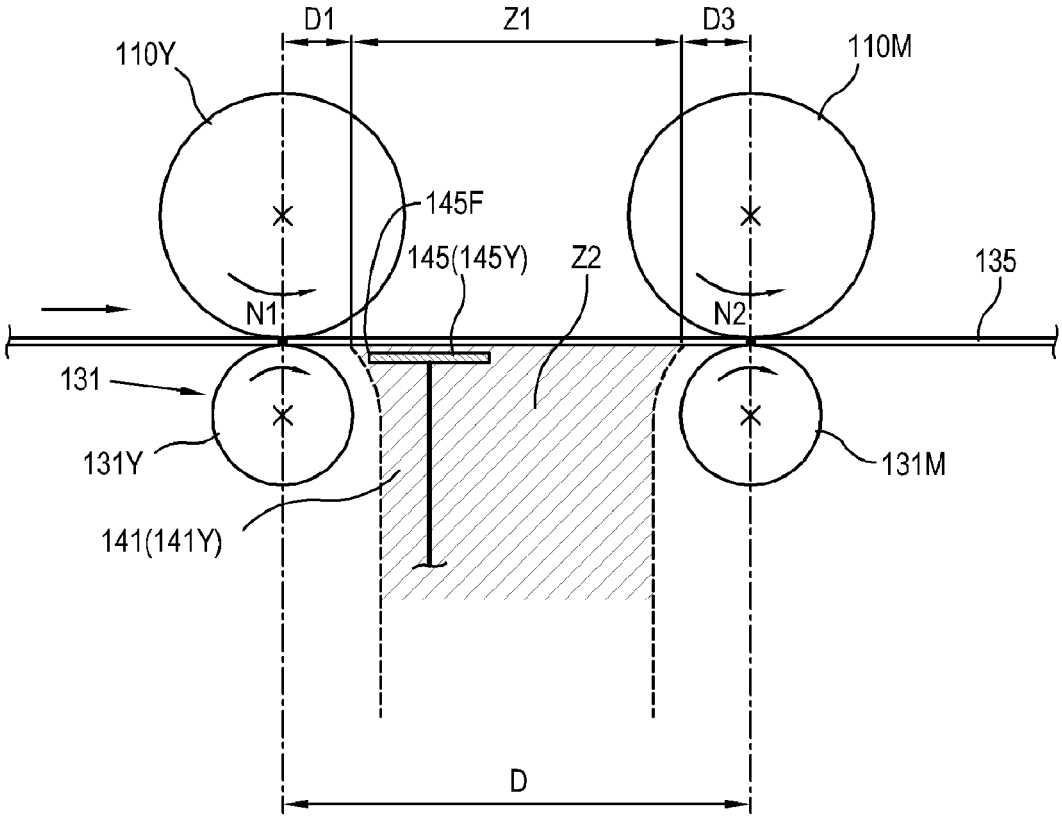
FIG. 7 schematically illustrates a main part of the image forming apparatus in FIG. 6.

FIG. 7 schematically illustrates a main part of the image forming apparatus 600 in FIG. 6. Referring to FIG. 7, the first eraser 145Y may be disposed between the first transfer roller 131Y and the second transfer roller 131M, in a zone Z1 satisfying the above-described formula 1.

By arranging each eraser 145Y in zone Z1 in this way, the first transfer grade can be maintained as illustrated in Table 1. Thus, current leakage, which may be generated due to a close distance between a center N1 of a transfer nip and an end part of the eraser 145Y, can be prevented.

Further, the image forming apparatus 600, according to another embodiment of the present general inventive concept may include an auxiliary eraser 147 disposed between the fourth transfer roller 131K and the fixing unit 150. The auxiliary eraser 147 may include an erasing plate disposed in parallel with the printing medium traveling path, like the first to third erasers 145Y, 145M and 145C. The auxiliary eraser 147 may be arranged in a zone Z3 satisfying the above-described formula 3. By arranging the auxiliary eraser 147 in zone Z3, the first transfer grade can be maintained as illustrated in Table 1.

Additionally, the first eraser 145 illustrated in FIG. 7 may be defined as having a distal end 145F disposed toward the first transfer nip and a distal end opposite 145F and disposed toward the second transfer nip. Also, the first eraser 145Y has a length defined between the distal ends 145F disposed toward centers N1 and N2, wherein the length of the first eraser 145Y is larger than the thickness of the first eraser 145Y.

As described above, according to the present general inventive concept, the eraser may be disposed in such a zone as to satisfy formulas 1 to 2, thereby preventing current leakage toward the eraser, and thus inferior image quality.

Further, the auxiliary eraser may be disposed in such a zone as to satisfy formulas 3 and 4, thereby preventing an electrostatic offset and thus inferior image quality, even in a low-humidity environment and a duplex printing environment.

Although a few exemplary embodiments of the present general inventive concept have been illustrated and described, it will be appreciated by those skilled in the art that changes may be made in these embodiments without departing from the principles and spirit of the present general inventive concept, the scope of which is defined in the appended claims and their equivalents.

What is claimed is:

1. An image forming apparatus comprising:

a plurality of image bearing members spaced apart from each other and comprising a first image bearing member and a second image bearing member being disposed adjacent to the first image bearing member;

an exposure unit to form a latent image on each of the image bearing members;

a developing unit to form a visible image on each of the image bearing members;

a transfer unit to transfer the visible image onto a printing medium, comprising a plurality of transfer rollers, which are respectively disposed opposite to the plurality of image bearing members and to form a transfer nip between each transfer roller and each image bearing member, and a plurality of erasers, which are respectively disposed between the plurality of transfer rollers and to erase a transfer voltage in a printing medium; and a fixing unit to fix the visible image on the printing medium, wherein the plurality of transfer rollers comprises a first transfer roller and a second transfer roller which are disposed opposite to the first image bearing member and the second image bearing member, respectively, and at least one of the plurality of erasers being disposed between the first transfer roller and the second transfer roller in a zone Z1 satisfying the following formula:

$$D1 \leqq Z1 \leqq D-D3$$

D1=4.5 mm

D3=4.5 mm 9.0 mm<D where D1 is an allowable minimum distance between an end part of the eraser and a center of a first transfer nip formed between the first image bearing member and the first transfer roller; D3 is an allowable minimum distance between the end part of the eraser and a center of a second transfer nip formed between the second image bearing member and the second transfer roller; and D is a distance between the center of the first transfer nip and the center of the second transfer nip.

2. The image forming apparatus according to claim 1, wherein each of the plurality of erasers comprises:

a first erasing plate disposed substantially perpendicular to a traveling path of the printing medium.

3. The image forming apparatus according to claim 2, wherein at least one of the first erasing plates is disposed in a zone Z2 satisfying the following formula:

$$R1+D2 \leqq Z2 \leqq D-(R2+D4)$$

D2=1.7 mm

D4=1.7 mm where R1 is a radius of the first transfer roller; R2 is a radius of the second transfer roller; D2 is an allowable minimum distance between the first erasing plate of the eraser and the nearest periphery of the first transfer roller; and D4 is an allowable minimum distance between the first erasing plate of the eraser and the nearest periphery of the second transfer roller.

4. The image forming apparatus according to claim 1, wherein each of the plurality of erasers comprises:

a second erasing plate disposed in parallel with a traveling path of the printing medium.

5. The image forming apparatus according to claim 1, wherein the transfer unit further comprises:

a transfer belt passing between the plurality of image bearing members and the plurality of transfer rollers and feeding the printing medium.

6. The image forming apparatus according to claim 1, wherein the transfer unit further comprises:

an auxiliary eraser disposed between the transfer roller in the most downstream position along the printing medium traveling path and the fixing unit and erasing a transfer voltage in the printing medium.

7. The image forming apparatus according to claim 6, wherein an end part of the auxiliary eraser is disposed in a zone Z3 satisfying the following formula:

$$D5 \leqq Z3 < DF$$

D5=4.5 mm where D5 is an allowable minimum distance along the printing medium traveling path between a center of a last transfer nip formed between the image bearing member adjacent to the fixing unit and the corresponding transfer roller and the end part of the auxiliary eraser; and DF is a distance along the printing medium traveling path between the center of the last transfer nip and a center of a fixing nip of the fixing unit.

8. The image forming apparatus according to claim 7, wherein the auxiliary eraser comprises:

an auxiliary erasing plate disposed substantially perpendicular to the printing medium traveling path, the auxiliary erasing plate being disposed in a zone Z4 satisfying the following formula:

$$R3+D6 \leqq Z4 \leqq DF-R4$$

D6=1.7 mm

D6≦DF where R3 is a radius of the transfer roller adjacent to the fixing unit; R4 is a radius of a pressing roller of the fixing unit; and D6 is an allowable minimum distance between the auxiliary erasing plate of the auxiliary eraser and the nearest periphery of the transfer roller adjacent to the fixing unit.

9. The image forming apparatus according to claim 7, the auxiliary erasing plate of the auxiliary eraser is disposed in parallel with the printing medium traveling path.

* * * * *